US006382915B1

(12) United States Patent
Aschermann et al.

(10) Patent No.: US 6,382,915 B1
(45) Date of Patent: May 7, 2002

(54) FAN WITH AXIAL BLADES

(75) Inventors: Uwe Aschermann, Karlsruhe; Uwe Blass, Moeglingen, both of (DE)

(73) Assignee: Behr GmbH & Co., Stuttgart (DE)

( * ) Notice: Subject to any disclaimer, the term of this patent is extended or adjusted under 35 U.S.C. 154(b) by 0 days.

(21) Appl. No.: 09/573,997

(22) Filed: May 19, 2000

(30) Foreign Application Priority Data

Jun. 30, 1999 (DE) ..... 199 29 978

(51) Int. Cl.[7] ..... F04D 29/00
(52) U.S. Cl. ..... 416/169 A
(58) Field of Search ..... 416/169 A

(56) References Cited

U.S. PATENT DOCUMENTS

| | | | | |
|---|---|---|---|---|
| 4,915,588 A | * | 4/1990 | Brackett | 416/189 |
| 5,645,401 A | | 7/1997 | Martin et al. | 416/169 A |
| 5,984,631 A | | 11/1999 | Tolgos | 415/194 |
| 6,010,305 A | * | 1/2000 | Hauser | 416/169 A |
| 6,027,307 A | * | 2/2000 | Cho et al. | 416/169 A |

FOREIGN PATENT DOCUMENTS

| | | |
|---|---|---|
| DE | 44 45 671 | 6/1996 |
| DE | 195 25 699 | 1/1997 |
| EP | 0 515 839 | 12/1992 |
| GB | 2 041 103 | 9/1980 |

* cited by examiner

*Primary Examiner*—John Kwon
(74) *Attorney, Agent, or Firm*—Foley & Lardner

(57) ABSTRACT

The invention relates to an axial fan, in particular for radiators of motor vehicles, the axial blades being fastened to a fan hub, and the fan hub in turn being connected to a viscous fluid friction clutch. According to the invention, air-guide elements or guide blades are arranged in the hub region on the front side or suction side of the axial fan. These air-guide elements or guide blades deflect the flow from the front side to the rear side of the blades and thereby stabilize the flow. To further improve the flow conditions, the hub region is covered by a cap on its front side. The cooling-air flow on the front side of the viscous fluid friction clutch and the hub flow of the fan are stabilized by the air-guide elements in combination with the

16 Claims, 6 Drawing Sheets

20
21
22
24
25
26
27
27'
28
29
30
A
V
$S_1$
$S_2$
$S_3$
$D_1$

FAN WITH AXIAL BLADES

BACKGROUND OF THE INVENTION

The present invention relates to a fan with axial blades, in particular for radiators of motor vehicles. This general type of fan has been disclosed in commonly assigned DE-A 44 45 671 and EP-A 515 839.

The axial fan according to DE-A 44 45 671 has a cylindrical hub on which an air-guide ring (also called a cap) is arranged at the front end in order to improve the incident flow. This cap divides the air flow into a main flow via the hub and a secondary flow via the viscous fluid friction clutch, but this entails special design measures with regard to the secondary flow and increased pressure losses. According to EP-A 515 839, the fan hub has a so-called hub ramp on the pressure side of the axial blades. Although the flow is stabilized on the rear side of the blades by the hub ramp, the flow conditions on the front side of this fan are still capable of being improved, in particular if the fan is fastened to a viscous fluid friction clutch. In such arrangements involving a viscous fluid friction clutch and axial fan, the objective is to bring both flow components, that is the cooling-air flow via the front side of the clutch and the incident flow for the fan hub, together to the greatest extent possible free of disturbance.

SUMMARY OF THE INVENTION

One object of the present invention therefore resides in improving the flow conditions for axial fans of the general type mentioned above. It is a particular object of the invention to provide a fan that coordinates the cooling-air flow for the clutch and the incident flow for the fan in an effective manner.

In accomplishing the foregoing objects, there has been provided according to one aspect of the present invention a fan for a motor vehicle radiator, comprising a fan hub; a plurality of axial blades fastened to the fan hub; a plurality of air-guide elements mounted on the hub and arranged in the air-inlet-side region of the hub and extending to the suction side of the axial blades. According to a preferred aspect the fan further includes a hub ramp which rises against the direction of fan rotation provided on the pressure side of each axial blade, and wherein the air-guide elements are arranged upstream of the hub ramps as viewed in the direction of air flow.

There has also been provided a motor vehicle embodying the radiator cooling fan according to the invention.

Further objects, features and advantages of the present invention will become apparent from the detailed description of preferred embodiments that follows, when considered together with the accompanying figures of drawing.

DETAILED DESCRIPTION OF THE PREFERRED EMBODIMENTS

Figure 1:
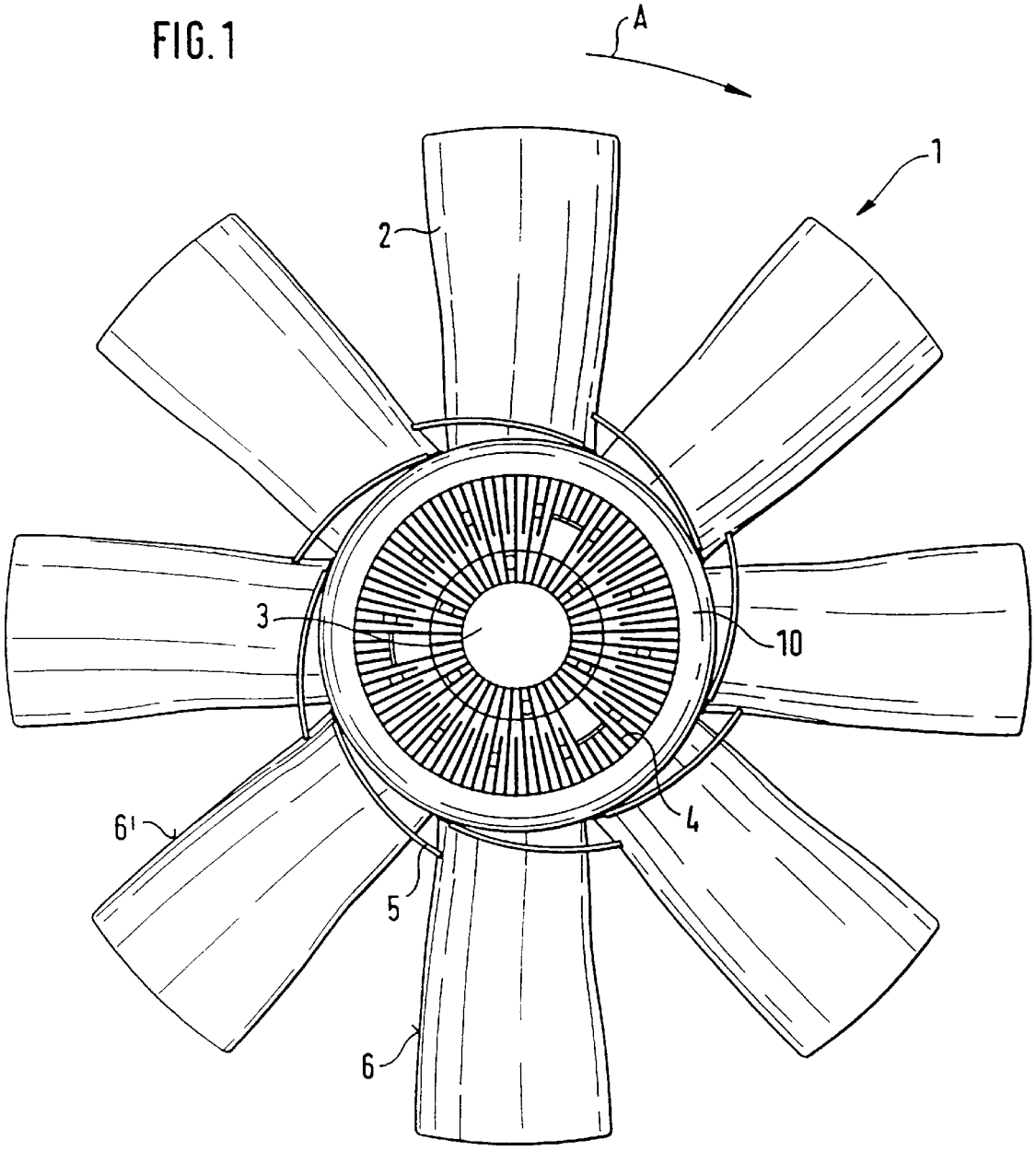
FIG. 1 is a front view of an axial fan according to the invention, i.e., as viewed in the direction of air flow.

The invention is applicable to fans of different design, e.g., those based on a cylindrical hub, and those which are based on a hub having one or more ramps. Accordingly, air-guide elements are arranged on the front side of the axial blades, that is essentially in the suction-side region, although portions of these air guide elements may and preferably do extend into the region on the back or downstream side of the blades (pressure side). These air-guide elements form a flow passage and direct the air specifically from the front side to the rear side of the blades, i.e., into the region of the cylindrical hub or into the region of the hub ramp. The hub ramp therefore has a further beneficial effect on the flow produced by the air-guide elements, i.e., in the sense of stabilizing the flow in the rear hub region. This results in a neat and low-loss flow around the blade roots in the hub region.

In one preferred embodiment of the invention, the axial fan is fastened to a viscous fluid friction clutch. The radially oriented cooling ribs arranged on the viscous fluid friction clutch result in a flow which is directed radially outward and meets the incident flow of the axial blades. In this case, the air-guide elements act virtually like the blades of a centrifugal fan, in which the flow enters radially and discharges essentially tangentially or semiaxially. The air-guide elements therefore define a flow passage which directs the air flow directly to the hub ramp in the pressure region of the axial blades. In this way, an effective air flow is ensured, i.e., on the one hand for cooling the clutch and on the other hand for flowing through the axial fan.

A further advantageous embodiment of the invention resides in the fact that the hub region is covered at the front end by a cap, which covers the air-guide elements or the flow passages formed by them at the front side, i.e., toward the side of the incident air flow, and encases them in a fluidically favorable manner. By means of this cap, on the one hand, the radially directed cooling-air flow of the clutch is "captured", and on the other hand, the hub front region is formed in a fluidically favorable manner for improving the hub flow.

Exemplary embodiments of the invention are shown in the drawings and described in more detail below.

FIG. 1 is a front view showing an axial fan 1, consisting of a hub 10 with eight axial blades 2, i.e., as viewed in the direction of air flow. A viscous fluid friction clutch 3, which has radially running cooling ribs 4 on its front side, is arranged in the radially inner region. In a way which is not shown in detail but is conventional, the axial fan 1 is connected to the output side of the viscous fluid friction clutch 3. This unit, consisting of axial fan and viscous fluid friction clutch, serves to deliver cooling air through the radiator of a motor vehicle for cooling the internal combustion engine. Blade-shaped air-guide elements 5, which serve to influence the air flow, are arranged in the region of the roots of the axial blades 2. In this preferred embodiment, an air-guide element 5 is assigned to each blade 2 and extends in the circumferential direction approximately from the leading edge 6 up to the next leading edge 6' of the adjacent blade, i.e., single blade pitch. Other lengths are also possible. The direction of rotation of the fan is indicated by an arrow A.

Figure 2:
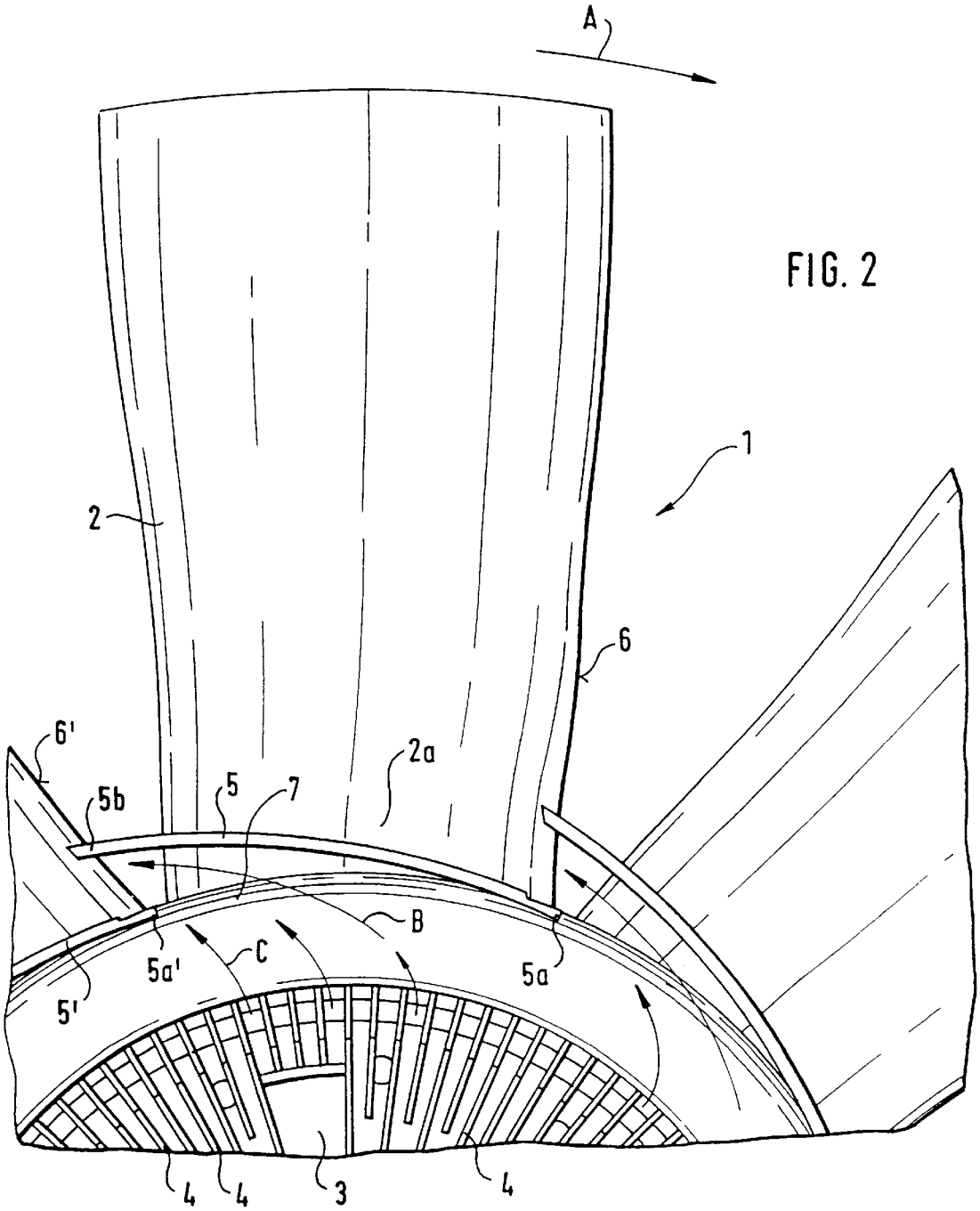
FIG. 2 is a partial view of the fan according to FIG. 1 in the region of the blade root.

FIG. 2 shows a partial view of the axial fan 1, again as viewed in the direction of air flow, i.e., in a view toward the front side of the coupling 3 and the fan 1. Arranged in the root region 2*a* of the axial blades 2 on their front side, i.e., suction side, is an air-guide element 5, which extends in a slightly curved manner essentially in the tangential direction, preferably starting in the region of the leading edge 6 of the blade 2 and ending approximately in the region of the adjacent leading blade edge 6'. The radial distance of the guide element 5 from its front region 5*a* up to its end region 5*b* increases against the direction of rotation (arrow A), so that a blade-like profile is obtained. A passage opening 7 for the air flow is left between the respectively leading regions 5*a* and 5*a'* of adjacent air-guide elements 5 and 5'. Arranged radially inside the air-guide elements 5 is the viscous fluid friction clutch 3, which has a multiplicity of radially oriented cooling ribs 4, which give 15 the air flow an approximately radially oriented flow component, identified by arrows with the letter C. This air flow C enters the passage opening 7, is deflected in a tangential and an axial direction via the air-guide elements 5 and then strikes the suction side of the blades 2, which is explained below with reference to FIG. 4.

Figure 3:
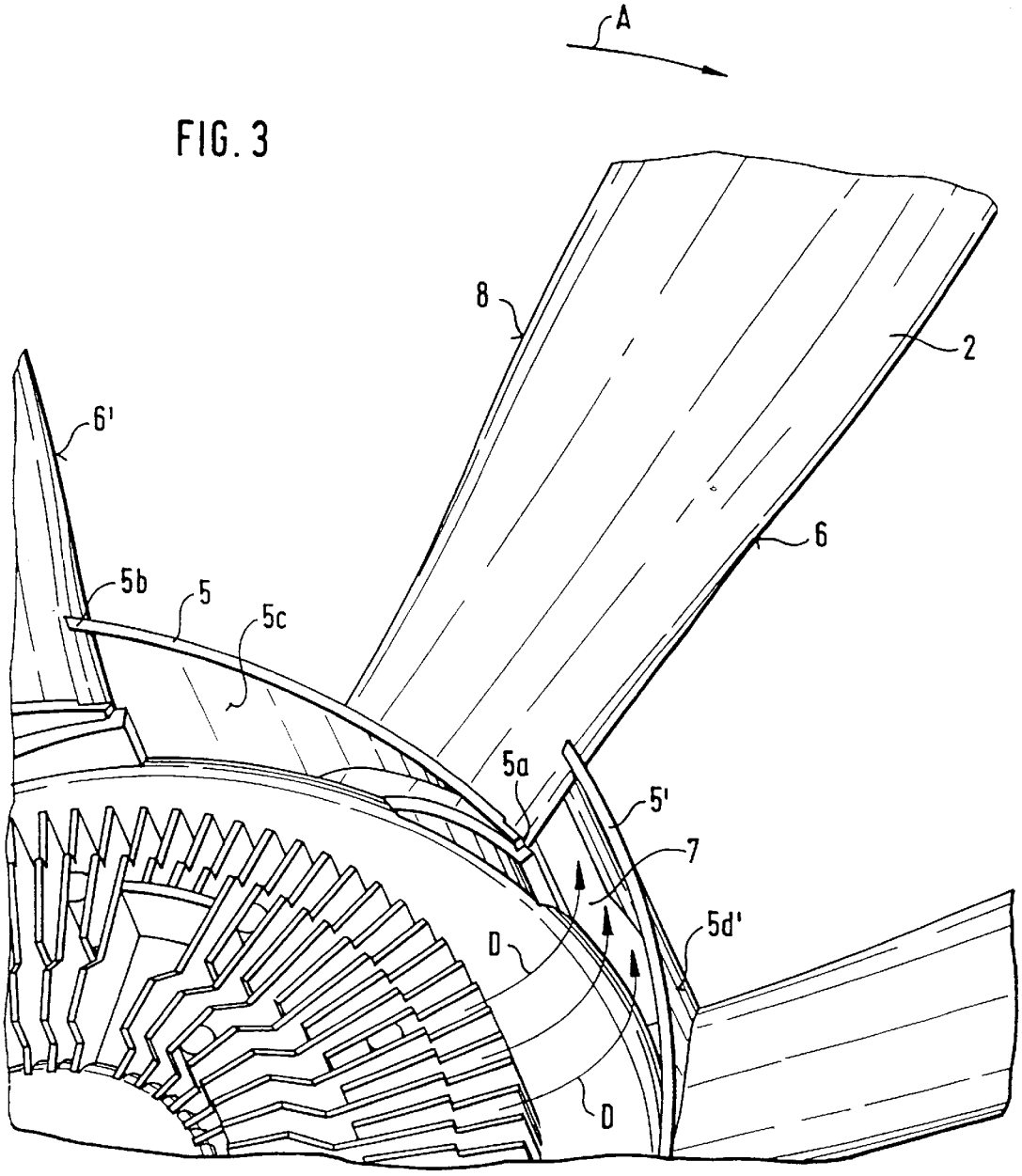
FIG. 3 is a perspective view in the hub region.

FIG. 3, in a partial perspective view, again as viewed essentially in the direction of incident flow, shows the deflection of the radial air flow into an approximately tangentially directed flow, shown by the arrows D. This air 25 flow D passes through the passage opening 7. This perspective representation, in addition to the representation according to FIG. 2, shows the axial extent of the air-guide elements 5 in one preferred embodiment, specifically, on the one hand, the axial extent of the underside 5*c* of the air-guide element 5 and the axial extent of the top side 5*d'* of the air-guide element 5'. It can therefore be seen that these air-guide elements 5 and 5' preferably extend over an axial region from the leading edge 6' of one blade up to the trailing edge 8 of an adjacent blade.

Figure 4:
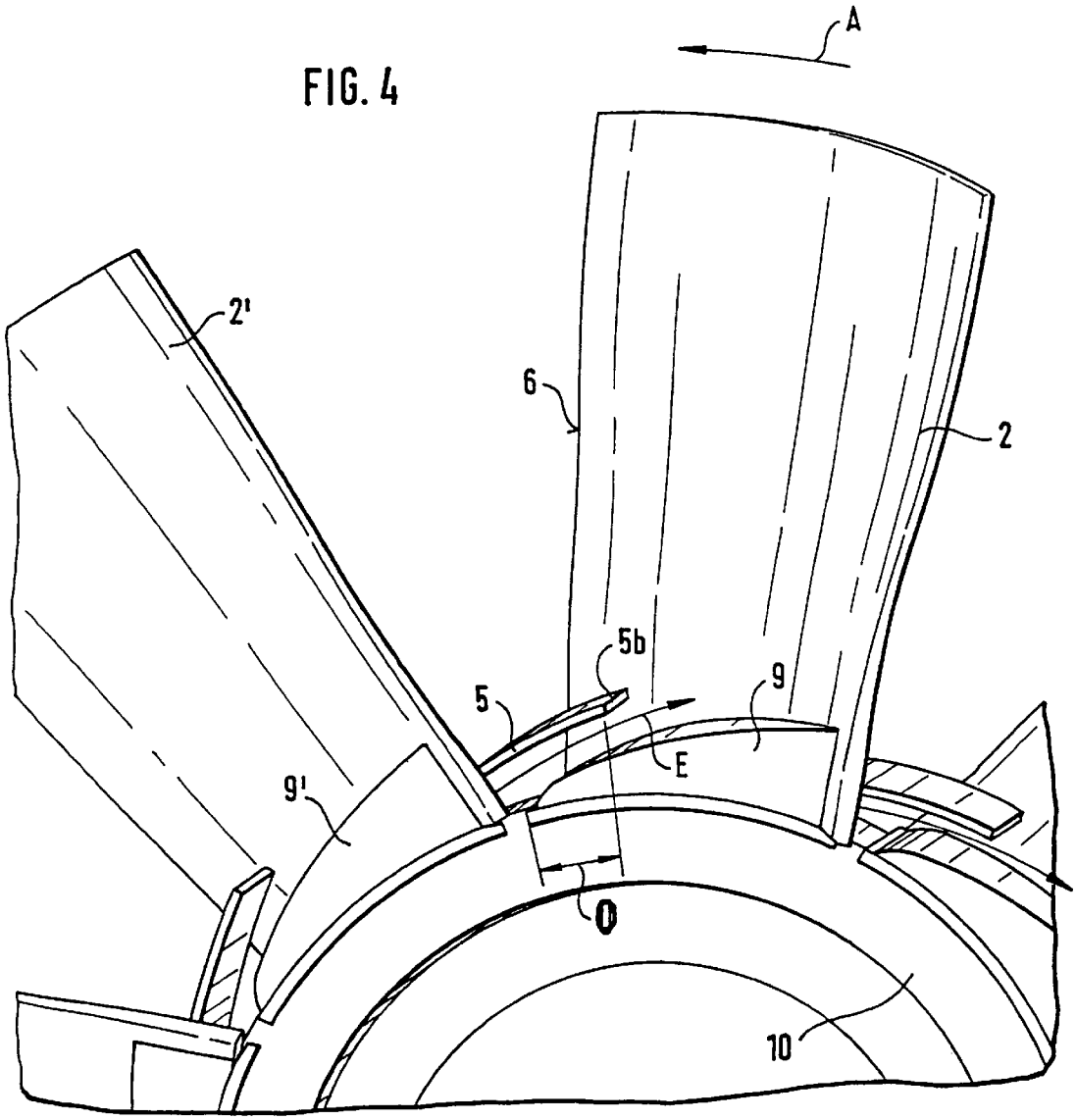
FIG. 4 is a perspective partial view of the axial fan from the rear side, i.e., as viewed against the direction of air flow.

FIG. 4 shows a complementary representation, i.e., a partial view of the axial fan from the rear side, i.e., essentially against the direction of air flow. The direction of rotation of the fan 1 is indicated by the arrow A. The fan blades 2 and 2', shown here, by way of example, each have a so-called hub ramp 9 and 9', respectively, in their root region, as has been disclosed in commonly assigned EP-A 515 839. The end region 5*b* of the air-guide element 5 is fastened in the region of the leading edge 6 of the axial blade 2. The air-guide element 5 therefore forms a flow passage with the hub ramp 9, i.e., in the region of a tangential overlap O. As a result, a defined direction is imposed on the air flow (arrow E), and further stabilization of the flow is achieved on the pressure (downstream) side of the blade 2.

The fan blades 2 and the associated hub ramps 9 are connected to the hub 10 preferably as a one-piece plastic injection molding. The air-guide elements 5 may also be integrally connected to the fan blades 2 or the hub by injection molding. Since the air-guide elements 5 form a two-dimensional area (cf. view according to FIGS. 1 and 2), they can be demolded in the axial direction of the fan.

Figure 5:
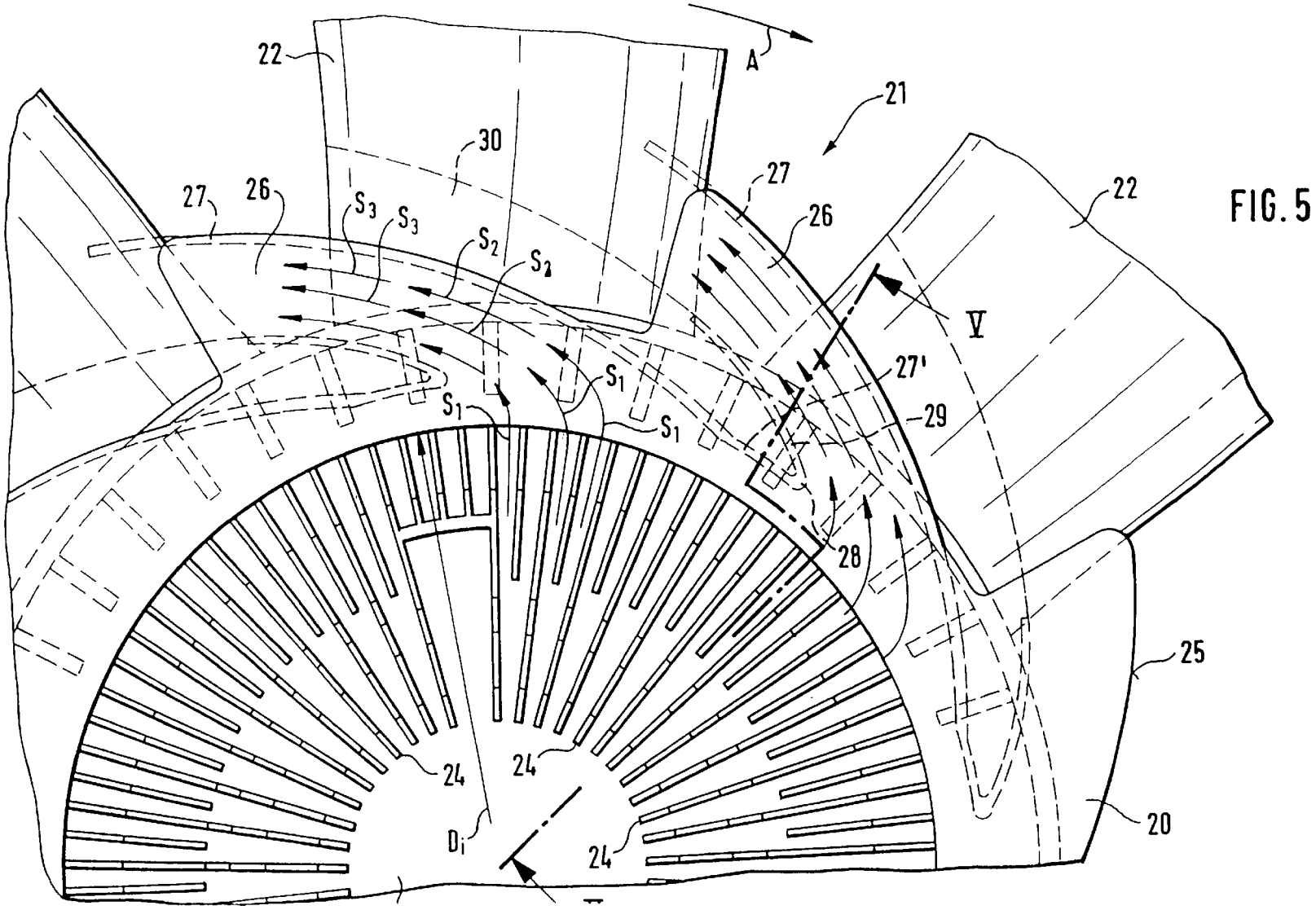
FIG. 5 is a partially front view of a further exemplary embodiment for an axial fan with cap according to the invention.
Figure 6:
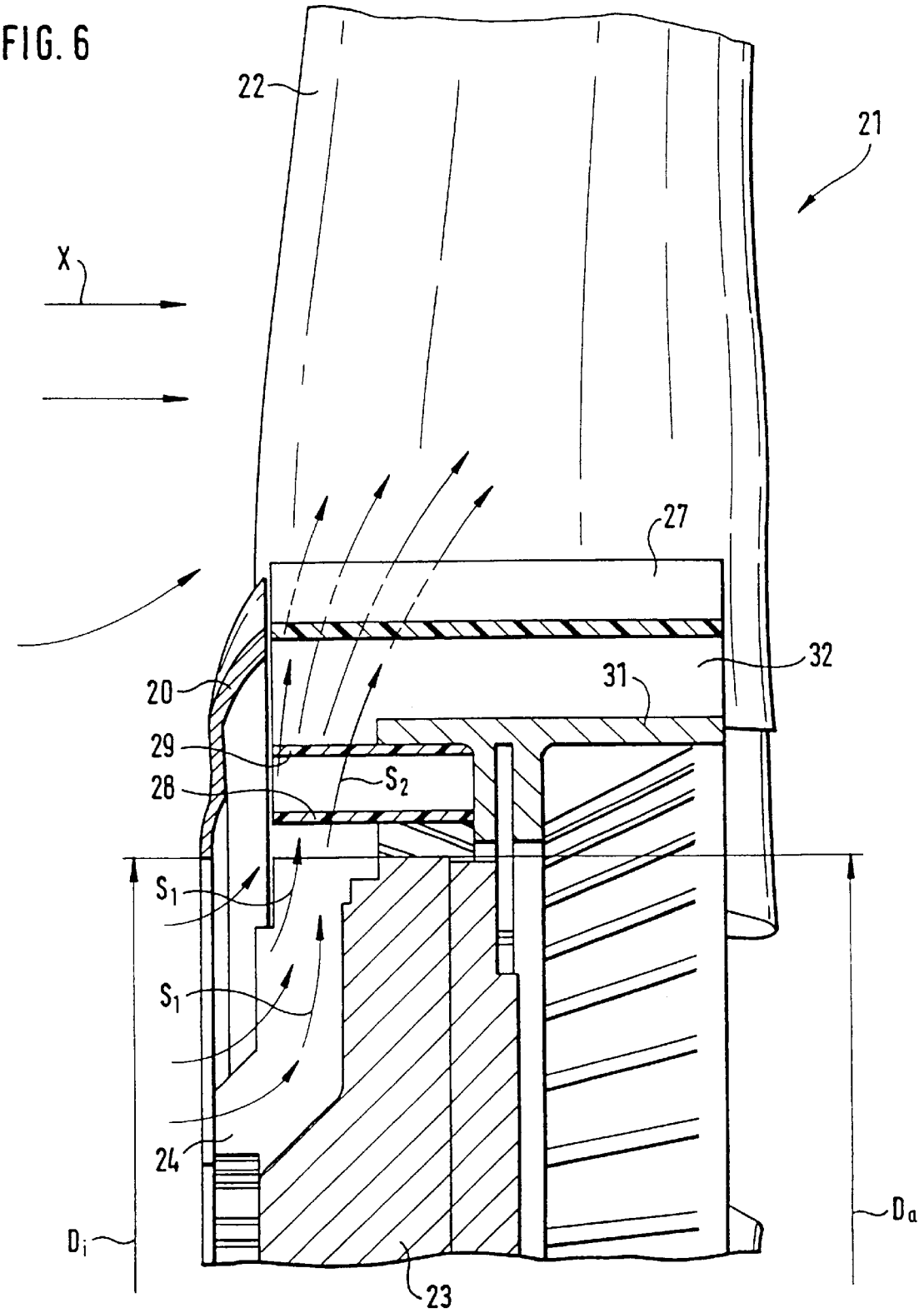
FIG. 6 is a sectional view of the fan according to FIG. 5.

FIGS. 5 and 6 show a further exemplary embodiment of the invention, wherein the front-end hub region is covered by a cap 20. The fan 21 has axial blades 22 and is fastened to a viscous fluid friction clutch 23, which has radially running cooling ribs 24 at its front end. The cap 20 is designed to be roughly annular, specifically with a circular internal cutout of diameter Di and a saw-tooth-shaped outer contour 25, wherein the "saw teeth" 26 are preferably roughly staggered relative to the axial blades 22. The saw-tooth-shaped profile 25 is partly adapted to the profile of guide blades 27 (which are similar to the previous exemplary embodiment). The cap 20 thus forms a front-side closure of the flow passages which are formed by the guide blades 27. Unlike the exemplary embodiment according to FIG. 2, the guide blades 27 in this exemplary embodiment extend over a larger circumferential region, which is about one to one and a half times the blade pitch. Here, with eight blades, the blade pitch works out as 360:8=45 degrees. The leading edge 27' of each guide blade 27 merges into a nose 28, which acts as a flow divider. The back of this nose 28 is formed by a further guide surface 29, which continues in the hub ramp 30 (indicated by broken lines) in the rear region of the blades. The air flow-is indicated by the arrows $S_1$, $S_2$ and $S_3$. Arrow $S_1$ is the essentially radially directed cooling-air flow produced by the cooling ribs 24 of the clutch, this cooling-air flow being "captured" by the guide blades 27 and the cap 20 and being deflected to the flow $S_2$ and $S_3$, which finally reaches the rear side of the blades (a factor no longer shown by arrows).

FIG. 6 shows a section along the bent line V—V in FIG. 5, i.e., an axial section through fan and clutch. The viscous fluid friction clutch 23 is shown hatched for the sake of simplification, has an outside diameter $D_a$ and carries the radially oriented cooling ribs 24 on its front side. The fan 21 is connected to the clutch 23 via a hub 31. On the front side or incident-flow side of the fan, the hub region is covered by the cap 20, which has an inside diameter $D_i$. The direction of the incident air flow (undisturbed) is identified by the arrows X. In the radially inner region, i.e., in the region of the cooling ribs 24, the at first axially directed air flow is deflected into a radial flow $S_1$, which in its radially outer region, identified by the arrows $S_2$, is covered by the cap 20. In this region, the flow $S_2$ enters a flow passage 32, which is defined radially on the outside by the guide blade 27 and radially on the inside by the guide surface 29. The flow thus passes relatively undisturbed into the rear hub region and combines there with the hub flow.

It will be understood by persons skilled in this art that numerous changes are possible to the exemplary embodiments described above, without changing the basic operation or function of the fan according to the invention. It is intended that all such obvious modifications will be covered by the appended claims.

The disclosure of German Patent Application No. DE 199 29 978.1, filed Jun. 30, 1999, is incorporated herein by reference in its entirety.

We claim:

1. A fan for a motor vehicle radiator, comprising:

a fan hub;

a plurality of axial blades fastened to the fan hub;

a plurality of air-guide elements mounted on the hub and arranged in the air-inlet-side region of the hub and extending to the suction side of the axial blades.

2. A fan as claimed in claim 1, further comprising a hub ramp which rises against the direction of fan rotation provided on the pressure side of each axial blade, and wherein the air-guide elements are arranged upstream of the hub ramps as viewed in the direction of air flow.

3. A fan as claimed in claim 1, wherein the air-guide elements are designed as curved guide blades.

4. A fan as claimed in claim 3, wherein each guide blade extends circumferentially from the leading edge of one axial blade approximately up to the leading edge of the adjacent axial blade.

5. A fan as claimed-in claim 2, wherein the air-guide elements are designed as curved guide blades.

6. The fan as claimed in claim 5, wherein each guide blade extends circumferentially over a region which is greater than one blade pitch.

7. A fan as claimed in claim 3, wherein an air-passage opening is defined between the leading region of a guide blade and the leading region of an adjacent guide blade.

8. A fan as claimed in claim 1, further comprising a viscous fluid friction clutch arranged radially inside the fan hub.

9. A fan as claimed in claim 8, wherein the viscous fluid friction clutch has radially running cooling ribs that produce an air flow directed generally radially outward.

10. A fan as claimed in claim 8, wherein a portion of the front-end region of the hub is covered by a cap.

11. A fan as claimed in claim 10, wherein the cap is roughly annular and has a generally circular inner contour and a saw-tooth-shaped outer contour.

12. A fan as claimed in claim 10, wherein the cap has an inside diameter $D_i$ corresponding approximately to the outside diameter $D_a$ of the viscous fluid friction clutch.

13. A motor vehicle comprising an internal combustion engine; a radiator for cooling the engine; and a fan for directing air against the radiator, said fan comprising:

a fan hub;

a plurality of axial blades fastened to the fan hub;

a plurality of air-guide elements mounted on the hub and arranged in the air-inlet-side region of the hub and extending to the suction side of the axial blades.

14. A fan for a motor vehicle, comprising:

a fan hub;

a plurality of axial blades fastened to the fan hub;

a plurality of air-guides elements mounted on the hub and arranged in the air-inlet side region of the hub and extending to the suction side of the axial blades, wherein the air guide elements extend past the roots of the axial blades in an axial direction.

15. A fan for a motor vehicle, comprising:

a fan hub;

a plurality of axial blades fastened to the fan hub;

a plurality of air-guides elements mounted on the hub and arranged in the air-inlet side region of the hub and extending to the suction side of the axial blades, wherein each air guide element extends circumferentially over a region which is greater than one blade pitch.

16. A fan for a motor vehicle, comprising:

a fan hub;

a plurality of axial blades fastened to the fan hub;

a plurality of air-guides elements mounted on the hub and arranged in the air-inlet side region of the hub and extending to the suction side of the axial blades, wherein each air guide element extends circumferentially from the leading edge of one axial blade approximately up to the leading edge of the adjacent blade.

* * * * *